United States Patent [19]

Felgentreu

[11] Patent Number: 5,000,606

[45] Date of Patent: Mar. 19, 1991

[54] DROP-WEIGHT AND TUBULAR WRITING INSTRUMENT

[75] Inventor: Peter Felgentreu, Hamburg, Fed. Rep. of Germany

[73] Assignee: Koh-I-Noor Rapidograph, Inc., Bloomsbury, N.J.

[21] Appl. No.: 347,215

[22] Filed: May 4, 1989

[30] Foreign Application Priority Data

May 7, 1988 [DE] Fed. Rep. of Germany ..... 3815712
Oct. 15, 1988 [DE] Fed. Rep. of Germany ..... 3835146

[51] Int. Cl.[5] ..... B43K 8/00; B43K 15/00
[52] U.S. Cl. ..... 401/258; 401/177
[58] Field of Search ..... 401/199, 258, 177, 89

[56] References Cited

U.S. PATENT DOCUMENTS

| | | | |
|---|---|---|---|
| 507,348 | 10/1893 | Beaumel | 401/258 |
| 2,217,502 | 4/1940 | Wallace . | |
| 3,561,881 | 2/1971 | Bok | 401/258 |
| 3,905,709 | 9/1975 | Bok | 401/258 |
| 4,408,921 | 10/1983 | Nagai | 401/89 |
| 4,728,214 | 3/1988 | Mutschler | 401/258 |

FOREIGN PATENT DOCUMENTS

| | | | |
|---|---|---|---|
| 0341484 | 11/1989 | European Pat. Off. . | |
| 744671 | 1/1944 | Fed. Rep. of Germany . | |
| 1984015 | 8/1964 | Fed. Rep. of Germany . | |
| 1611802 | 3/1970 | Fed. Rep. of Germany . | |
| 3434188 | 3/1986 | Fed. Rep. of Germany . | |
| 3538285 | 7/1986 | Fed. Rep. of Germany | 401/199 |
| 3538286 | 7/1986 | Fed. Rep. of Germany | 401/199 |
| 44969 | 10/1988 | Fed. Rep. of Germany | 401/258 |
| 3815712 | 11/1989 | Fed. Rep. of Germany . | |
| 3835146 | 11/1989 | Fed. Rep. of Germany . | |
| 986766 | 8/1951 | France . | |

*Primary Examiner*—Richard J. Johnson
*Attorney, Agent, or Firm*—Fitzpatrick, Cella, Harper & Scinto

[57] ABSTRACT

A drop weight for a tubular writing instrument has a drop weight body consisting of an upper and lower part (20; 22). The lower part (22) has a front support surface for supporting the drop weight body in its front position inside the tubular writing instrument, and the cleaning wire (21) is fixed to the bottom of the upper part (20). The two parts (20, 22) can be axially moved in relation to each other, by means of which the distance between the front support surface and the front end of the cleaning wire (21) can be altered. In this way the projection of the cleaning wire (21) beyond the end of the writing tube (11) can be adjusted. Further, to set the projection of a cleaning wire (103), provided at the front end of a drop weight body (115), beyond the front end of the writing tube (102) of a tubular writing instrument, a bush element (116) having a shoulder area (117), is clampingly fastened on the drop weight body (115). To set the projection of the cleaning wire (116), the shoulder area (117) is brought into contact with an abutment area (109), so that the drop weight body (115) is in its frontal position. By displacing the bush element (116) along the drop weight body (115), a correct projection is attained, and the bush element (116) is then fixedly connected with the drop weight body (115).

22 Claims, 3 Drawing Sheets

DROP-WEIGHT AND TUBULAR WRITING INSTRUMENT

BACKGROUND OF THE INVENTION

1. Field of the Invention

The invention relates to a drop weight for a tubular writing instrument, having a drop weight body and a cleaning wire fixed thereon, the drop weight body consisting of two parts. A lower part provides a front support surface for the support of the drop weight body in its frontal position inside the tubular writing instrument. The two parts are displaceable in relation to each other in the direction of the longitudinal extension of the cleaning wire, at least during a first operational state.

The invention further relates to a tubular writing instrument having a drop weight body located in an inner bore of a housing which is connected with a writing fluid supply chamber and which has in its front end a cleaning wire extending into the writing tube and having a drop weight retainer to limit the displacement of the drop weight body in the direction towards the writing fluid supply chamber.

2. Related Prior Art

In a known drop weight of this type (German Published Patent Application DE-OS 16 11 802), the part of the drop weight body having the front support surface is in the shape of a rod and has annular shoulders. at both ends. The outer surface of the front shoulder constitutes a front support surface and the cleaning wire is fastened to this shoulder. An auxiliary weight is located on the rod-shaped section of the drop weight body and its length is less than the distance between the two shoulders on the main part of the drop weight body, so that the auxiliary weight part of the drop weight body is movable axially back and forth in relation to the main part. When a tubular writing instrument containing such a drop weight is shaken, impulses are created by the auxiliary weight part of the drop weight body, so as to improve the movability of the drop weight and more particularly to cause loosening of the cleaning wire, which perhaps might have become stuck in the writing tube becomes of dried writing fluid.

When manufacturing tubular writing instruments having a cleaning wire extending inside the writing tube, it is necessary to set the length of the cleaning wire so that an exactly defined projection of the front end of the cleaning wire beyond the front end of the writing tube results when the drop weight is supported by its front support surface inside the tubular writing instrument. Because the front end of the cleaning wire must also be rounded to prevent scratching of the writing or drawing surface, setting of the desired distance is difficult. It is not possible to manufacture the cleaning wire first with a considerably increased projection and then simply cut the wire to the desired length, after insertion into the tubular writing instrument.

For setting the desired projection of the cleaning wire beyond the front end of the wiring tube it is also already known (German Published Patent Application DE-OS 34 34 188) to use an external screw thread, ending at a rear stop. The rear stop supports a drop weight body as a drop weight restraint inside a tubular writing instrument to limit the axial back and forth movement, and to fix the position of the drop weight restraint in a manner resulting in a desired extended length of the cleaning wire. However, to do this a special support for the drop weight body is required one the one hand and, on the other, a specially shaped drop weight restraint must be fixed inside the tubular writing instrument in a particular manner.

In that known tubular writing instrument (German Patent Published Application DE-OS 34 34 188), the drop weight restraint is fixed, by means of a threaded bush, into the housing in such a way that the exact desired projection of the cleaning wire beyond the front end of the writing tube is attained, after which the threaded bush is permanently fixed in the housing.

In such a writing tube it is therefore possible to set the correct projection of the cleaning wire beyond the front end of the writing tube exactly, without the requirement of treating the front end of the cleaning wire. After assembly, the drop weigh body, togehter with the drop weight restraint, can be screwed out of the housing and can also be re-inserted into the housing. When re-inserted, the exact and correct projection of the cleaning wire beyond the front end of the writing tube is again attained.

OBJECT AND SUMMARY OF THE INVENTION

It is a first object of the invention to provide a simple way to set the projection of the cleaning wire beyond the front end of the writing tube without having to rework or round the front end of the cleaning wire.

In order to attain this object, a drop weight of the type previously mentioned is designed in accordance with the invention so that the cleaning wire upper end is fasten to the lower end of the upper part of the drop weight body, and extends through a separate support defined in a lower surface of the lower part of the drop weight body. The two parts of the drop weight body are maintained in a fixed axial relationship to each other, in a second operational state.

Thus, in a drop weight according to the invention, a front support surface for supporting the drop weight body and the fastening of the cleaning wire are provided on different parts of the drop weitht body. The upper part holding the cleaning wire can be axially displaced in relation to the lower part having the support surface. In this way, the distance between the front end of the cleaning wire and the support surface and, therefore, the maximal projection of the cleaning wire beyond the end of the writing tube, can be set to a desired value. In a second operationl state the two parts are set to be maintained in a fixed axial relationship to each other, so that the maximal projection of the cleaning wire beyond the front end of the writing tube does not change during use, except by reason of the possible wear of the cleaning wire.

To perform this setting, the drop weight is inserted as usual into the tubular writing instrument and is brought into its front position, whereby a front support surface on the lower part of the drop weight body abuts against a projecting support area of the tubular writing instrument. In this position it is possible to determine whether the projection of the cleaning wire beyond the front end of the writing tube has a correct value. If this should not be the case, the two part of the drop weight body axially are displaced in relation to each other until the desired projection of the cleaning wire has been achieved.

The lower part of the drop weight body, i.e. the part having the front support surface, may be in the shape of a bush. The upper part extends into the bush-shaped lower part and has a bottom end section to which the cleaning wire is fastened. The bush-shaped part may have a reduced cross section central opening in a lower surface where the cleaning wire passes through, and the bush-shaped part is general cup-shaped.

In such a two-part design of a drop weight body the lower part may be of metal in order to attain the desired total weight, while the upper part may be of plastic, in which the cleaning wire simply can be fastened.

To provide a simple adjustment of the two parts in an axial direction in relation to each other, the two parts may be threaded together. However, it is also possible to maintain the two parts in a fixed position and displaceable in relation to each other by a type of clamping.

In the second operational state the two parts are preferably fixedly connected with each other, for example by means of an adhesive.

It is a second object of the invention to provide a tubular writing element in which it is possible, during assembly to set the projection of the cleaning wire beyond the front end of the writing tube with less of an effort than in known tubular writing elements.

To attain this object, a tubular writing instrument of the type previously mentioned is designed in accordance with the invention such during assembly, a separate housing element is clampingly fastened upon a drop weight body. A bush element has a radially outwardly extending shoulder area provided between the drop weight body and an abutment area of the housing, so that the housing is located between the housing abutment area and the writing tube.

Thus, in a tubular writing instrument according to the second object of the invention, the drop weight body has a bush element clampingly fastened on it, and thus is positionable in an axial direction. The clamping retention may have the form of a threaded connection. This bush element can be brought into a position, for a front position of the drop weitht body, that is determined by the abutment of the shoulder area of the bush element against the abutment area of the housing, so that the cleaning wire has exactly the correct projection beyond the front end of the writing tube. Therefore, in case the projection of the cleaning wire in not quite correct, it is merely required to slightly displace the clampingly fastened bush element on the drop weight body in the corresponding direction until the correct setting has been attained. When the desired position is achieved, the bush element either already is sufficiently fixed on the drop weight body or it is additionally fixed on it, as by gluing, etc. Hence, the bush element will not change its position, even if the drop weight body is moved back and forth in the usual manner by shaking the tubular writing instrument.

In one embodiment according to the invention, an inner bore of the housing may widen in the area of its rear end, so that the drop weight body extend into the widened section of the inner bore. A transition to the widened section of the inner bore then may form the abutment area for a shoulder area of the bush element.

The shoulder area of the bush element may further comprise an annular open area that is cut around its circumferential direction by axial fluid pass-through slits. To assure that writing fluid flow from the widened section of the inner bore to a narrower part of the inner bore is not hampered, the fluid pass-through slits may extend down into an area of the bush element that is located within the narrower section of the inner bore.

These objects of the invention will be described below by means of the drawings, which illustrate exemplary embodiments thereof.

DETAILED DESCRIPTION OF THE PREFERRED EMBODIMENTS

Figure 1:
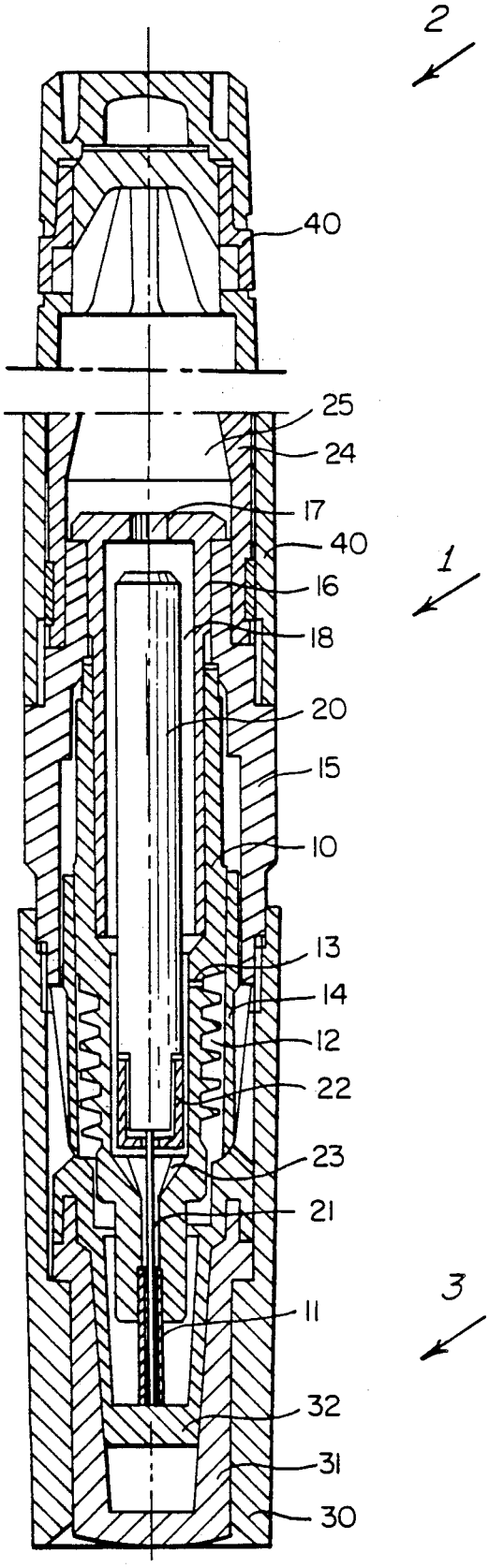
FIG. 1 is a partial section through a tubular writing instrument, according to a first embodiment.

The tubular writing instrument shown in FIG. 1 generally consists of a writing tube point 1, upon which a holder shaft 2 is screwed on from the back and a sealing cap 3, that is screwed on from the front.

The writing tube point 1 consists of a cylindrical body 10, with a front end into which a writing tube 11 is inserted. The cylindrical body also forms an inner bore 18 that communicates with the back end of the writing tube 11. In the inner bore 18 a drop weight, yet to be described, is located. The drop weight consists of a drop weight body made of two parts, an upper part 20 and a lower part 22, and a cleaning wire 21 that extends into the writing tube 11. To prevent the drop weight from falling out of the back end of the inner bore 18, a conventional drop weight retainer 16 is inserted into the inner bore 18 from behind, and includes a central bore 17 in its upper surface. A helical groove 12 is provided on the outer surface of the cylindrical body 10, the rear end of which being communicated via a lateral bore 13 with the inner bore 18, and the front end of which being connected with the ambient air. The groove 12 is covered with a sleeve element 14, in order to form a pressure equalization chamber.

A cylinder holder element 15 has been pushed from behind upon the rear end of the cylinder body 10 and is connected with it by ultrasonic welding. The rear end of the holder element 15 connects to a writing fluid reservoir 24, that forms a writing fluid supply chamber 25. Furthermore, a cylindrical shaft element 40 of the holder shaft 2 has been screwed from behind onto the cylindrical holder element 15. In its front section the cylindrical holder element 15 has an exterior thread for fastening to a main body 30 of the sealing cap 3, which further has an insert element 31, into which the sealing element 32 is inserted. Hence, when the sealing cap 3 has been screwed on, the sealing element sealingly abuts against the front end of the writing tube 11 and also makes a seal in the area of the front end of the sleeve element 14.

As already mentioned, the drop weight body consists of upper and lower parts. The lower part is a cup-shaped metal part 22 having a central opening in its bottom. The upper part is generally rod-shaped plastic part 20, which has a stepped down front end that is for a slight clamping engagement with the lower metal part 22. The cleaning wire 21 is fastened in the front end of the plastic part 20 and extends through a central opening in a front surface of the metal part 22.

In the position illustrated by the first embodiment of FIG. 1, the outer surface of the front surface of the metal part 22 will rest upon the ribs 23 provided on the inner bore 18, when the sealing cap 3 has been removed and the writing tube 11 has not been placed on a writing or drawing surface. This abutment of a surface of the lower metal part 22 that forms the front support surface of the drop weight body thus defines the position in which the cleaning wire 21 is displaced farthest to the front and, thus, defines the cleaning wire projection beyond the front end of the writing tube 11.

If, when the drop weight is first inserted into the tubular writing instrument, it appears that the resulting projection of the cleaning wire 21 beyond the front end of the writing tube 11 does not have the correct value, the assembler can change this projection by changing the axial distance between the lower metal part 22 and the upper plastic part 20, i.e. by either pushing the plastic part 20 further into the metal part 22 or pulling it out of it until the desired projection has been attained. Afterwards, a permanent bond between the plastic part 20 and the metal part 22 may be made, for example by gluing, so as to positively prevent relative axial displacement of these parts during use and any further change in the projection of the cleaning wire 21 beyond the front end of the writing tube 11.

Figure 2:
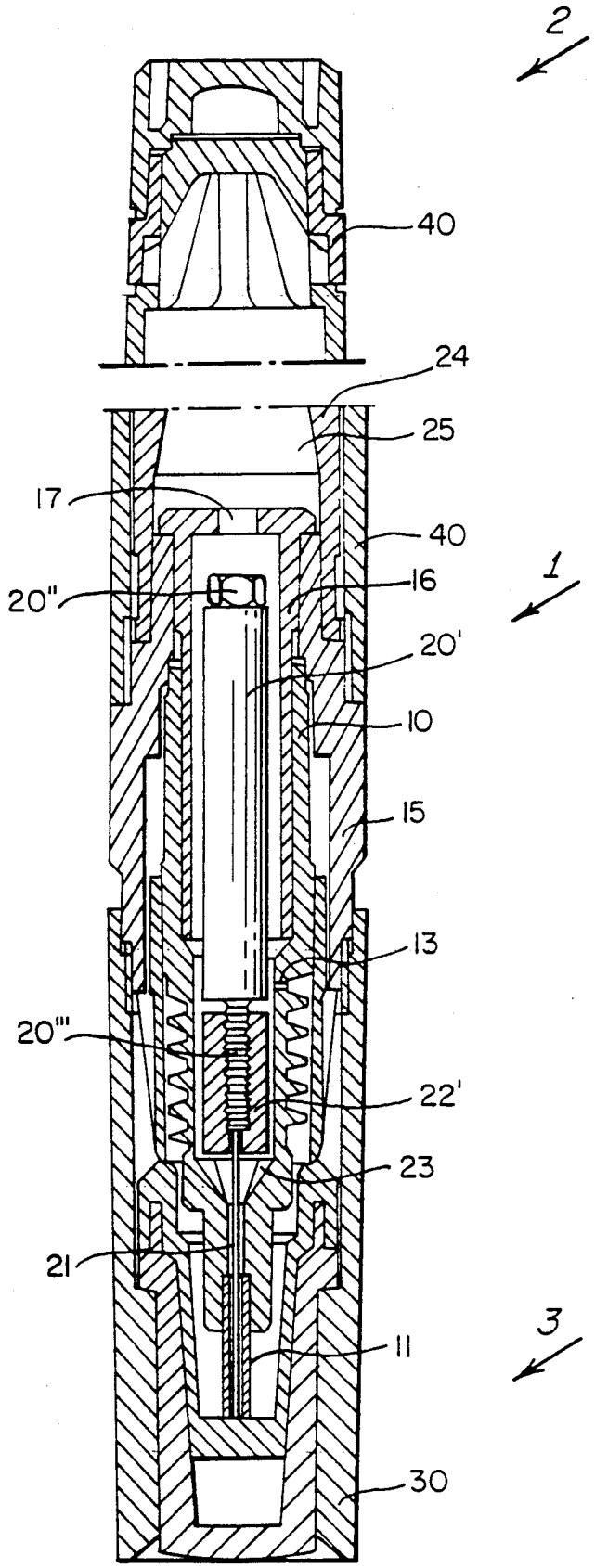
FIG. 2 corresponds generally to FIG. 1, and illustrates a second embodiment for a tubular writing instrument, having a drop weight variation from the first embodiment of FIG. 1.

In the second exemplary embodiment of FIG. 2 the tubular writing instrument is in general designed in the same way as in the embodiment of FIG. 1, and identical parts have been given indentical reference numerals.

The only divergence from the exemplary embodiment according to FIG. 1 lies in the construction of the drop weight, which has a rod-shaped upper part 20' and a threaded neck 20''' formed at its front end, to support a cleaning wire 21. The part 20' which, for example, is made of plastic, is screwed with its neck 20''' into a lower part 22', which is in general cup-shaped and made, for example, of metal, so that the cleaning wire 21' extends through a central opening in a front surface of the lower part 22'. A hexagonal head 20'' is located on the rear end of the upper part 20', so that the upper part 20' can be screwed futher into or out of the lower part 22' by holding the lower part 22' and turning the hexagonal head 20'' by means of a wrench or key.

By means of a relative axial displacement of the parts 20' and 22' achieved in this manner, it is possible to set the projection of the cleaning wire 21 beyond the end of the writing tube 11 to the desired value in the manner described in connection with FIG. 1. If desired, the parts 20' and 22' then can be connected with each other so as to be secure against further rotation.

Figure 3:
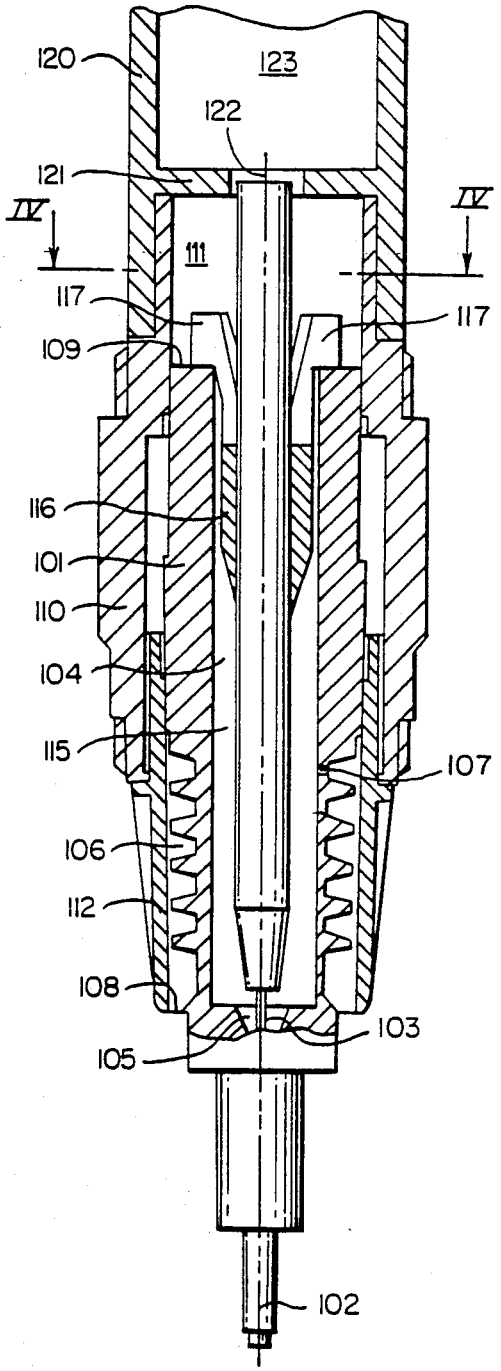
FIG. 3 is a partial section through a tubular writing instrument, according to a third embodiment.
Figure 4:
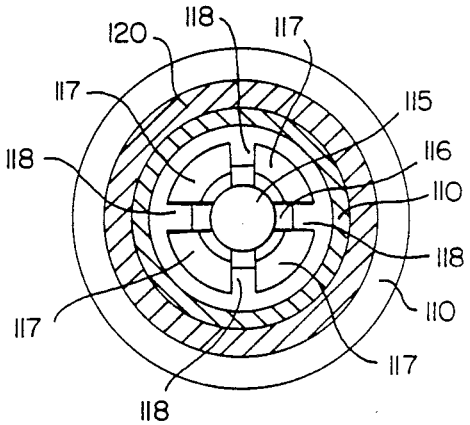
FIG. 4 is a section along the line II—II of FIG. 3.

The third embodiment tubular writing instrument, shown in FIG. 3, has a housing made of a front part 101, in the front end of which a writing tube 102 is fastened and which delimits the front chamber 104 of an inner bore which is connected at the front end, via a customary conduit 105, with the writing tube 102 and in which a drop weight body 115 is disposed. The drop weight body 115 has a cleaning wire 103 on its front end, which extends into the conduit 105 and into the writing tube 102.

On the outer surface of the front part 101 is disposed a customary helical pressure equalization chamber 106, which at the rear end is connected via a lateral bore 107 with the front chamber 104 of the inner bore and which is covered on its outer circumference by a sleeve 112 pushed from the front on the front part 101. An annular chamber 108 is formed between the front end of the sleeve 112 and the adjacent area of the front part 101, through which the front end of the pressure equalization chamber 106 is connected with the ambient air.

A rear part 110 of the housing is sealingly foxed to the outer surface of the front part 101 of the housing, as by gluing or welding. In the one direction the rear part 110 extends forward, forming an annular chamber for receiving the rear end of the sleeve 112, and in the other direction backwards, forming a cylindrical section, behind the rear end of the front part 101. This rear part 110, with its rear end, constitutes a continuation of the chamber 104 of the inner bore in the form of a rear chamber 111 having a diameter increased in relation to the front chamber 104. A writing fluid reservoir 120 is pushed on the rear section of the front part 110 and has an interior lateral wall 121 that abuts against the rear end of the rear part 110 of the housing. The lateral wall 121 forms a drop weight retainer with a central opening 122 for the passage of writing fluid from a writing fluid supply chamber 123, formed by the reservoir 120, into the front chamber 104, through rear chamber, 111.

As illustrated in FIG. 3, the drop weight body 115 extends through the front chamber 104 and the rear chamber 111 of the inner bore into the center opening 122 of the writing fluid reservoir 120. A bush element 116 is clampingly fastened around the drop weight body 115 and is disposed within the front chamber 104 of the inner bore by its front area. However, a small annular chamber is left for passage of writing fluid between bush element 116 and a limiting surface of the front chamber 104 of the inner bore formed by the front part 101. At the rear end of the bush element 116 an annular area 117 is formed, the outer diameter of which is larger than the inner diameter of the front chamber 104 of the inner bore. Accordingly, the annular area 117 of the bush element 116 provides a shoulder area that abuts against an abutment area, defined by a rear end surface 109 of the front part 101 of the housing, as can be seen in FIG. 3.

In order not to hamper the flow of writing fluid from the writing fluid supply chamber (through the central opening 122, through the annular space between the lateral wall 121 and the drop weight body 115, through the rear chamber 111 of the inner bore through the front chamber 104 of the inner bore, through the conduit 105 and then into the writing tube 102) the annular area 117 of the bush element 116 is cut by diametrical fluid pass-through slits 118. The slits extend axially, and are in the form of cuts from the rear end of the bush element 116 to approximately its center area and thus to the front chamber 104 of the inner bore. Writing fluid thereby reaches the front chamber 104 of the inner bore from the rear chamber 111 through these fluid pass-through slits 118, without hindrance.

When assembling the tubular writing instrument shown in FIG. 3, first the bush element 116 is pushed onto the drop weight body 115, so that it is clampingly held. Then the drop weight body 115 is inserted from the rear into the rear chamber 111 and the front chamber 104 of the housing, upon which the writing fluid reservoir 120 has as yet not been placed. To check the projection of the cleaning wire 103 beyond the front end of the writing tube 102, the assembly thus obtained is held with the writing tube 102 extending downwardly. If the result is that the projection is seen not to be set correctly, the bush element 116 is displaced in the appropriate direction on the drop weight body 115 until the proper projection has been attained.

It should be noted that, when the bush element 116 has been exactly positioned on the drop weight body 115, it can also be permanently connected with the drop weight body 115, e.g. by gluing.

Then the writing fluid reservoir 120 is pushed upon the rear end of the rear part 110 of the housing, so that the drop weight body 115 can be moved axially back and forth in the usual manner. Backward movement of the drop weight is limited by abutment of the rear end of the bush element 116 against the lateral wall 121 of the writing fluid reservoir 122, which forms a drop weight retainer. Forward of the drop weight is limited by movement by abutment of the annular area 117 against the abutment area 109.

While exemplary embodiments of the invention have been shown and described, it is to be understood that the invention is solely to be limited by the scope of the appended claims.

I claim:

1. A tubular writing instrument, comprising a drop weight and a cleaning wire fixed thereon, the drop weight including a drop weight body consisting of an upper part and a lower part, the lower part providing at a front surface thereof a support for the drop weight body in a frontal position inside the tubular writing instrument, wherein the upper and lower parts are displaceable in relation to each other in a direction of longitudinal extent of the cleaning wire for moving the cleaning wire in a first operational state and wherein further, a rear end of the cleaning wire is fastened to a front end of the upper part of the drop weight body and the upper and lower parts of the drop weight body are maintained in fixed positional alignment, for a second operational state.

2. A tubular writing instrument in accordance with claim 1, characterized in that the lower part is in the form of a bush and the upper part extends into the lower part with at least a front end area fastening to the cleaning wire.

3. A tubular writing instrument in accordance with claim 2, characterized in that the lower part has a central opening with a reduced cross section at a front surface thereof, through which the cleaning wire passes through.

4. A tubular writing instrument in accordance with claim 1, characterized in that the lower part is made of metal and the upper part is made of plastic.

5. A tubular writing instrument in accordance with claim 2, charcterized in that the lower part is made of metal and the upper part is made of plastic.

6. A tubular writing instrument in accordance with claim 3, charcterized in that the lower part is made of metal and the upper part is made of plastic.

7. A tubular writing instrument in accordance with claim 1, characterized in that the upper and lowe parts are fixedly connected in the second operational state.

8. A tubular writing instrument in accordance with claim 2, charcterized in that the upper and lower parts are connected by threading.

9. A tubular writing instrument in accordance with claim 3, characterized in that the upper and lower parts are connected by threading.

10. A tubular writing instrument in accordance with claim 4, characterized in that the upper and lower parts are connected by threading.

11. A method for setting the projection of a cleaning wire beyond a front end of a writing tube in a tubular writing instrument having a drop weight in accordance with claim 1, characterized in that the drop weight and cleaning wiwre assembly is inserted into the tubular writing instrument and brought into its frontal position, and then the upper and lower parts of the drop weight body are axially displaced in relation to each other until a desired projection of the cleaning wire has been attained.

12. A tubular writing instrument in accordance with claim 2, characterized in that the upper and lower parts are fixedly connected in the second operational state.

13. A tubular writing instrument in accordance with claim 3, characterized in that the upper and lower parts are fixedly connected in the second operaiton state.

14. A tubular writing instrument in accordance with claim 4, characterized in that the upper and lower parts are fixedly connected in the second operational state.

15. A method for setting the projection of a cleaning wire beyond a front end of a writing tube in tubular writing instrument having a drop weight in accordance with claim 2, characterized in that the drop weight and cleaning wire assembly is inserted into the tubular writing instrument and brought into its frontal position, and then the upper and lower parts of the drop weight body are axialy displaced in relation to each other until a desired projection of the cleaning wire has been attained.

16. A method for setting the projection of a cleaning wire beyond a front end of a writing tube in a tubular writing instrument having a drop weight in accordance with claim 3, characterized in that the drop weight and cleaning wire assembly is inserted into the tubular writing instrument and brought into its frontal position, and then the upper and lower parts of the drop weight body are axially displaced in relation to each other until a desired projection of the cleaning wire has been attained.

17. A method for setting the projection of a cleaning wire beyond a front end of a writing tube in a tubular writing instrument having a drop weight in accordance with claim 4, characterized in that the drop weight and cleaning wire assembly is inserted into the tubular writing instrument and brought into its frontal position, and then the upper and lower parts of the drop weight body are axially displaced in relation to each other until a desired projection of the cleaning wire has been attained.

18. A method for setting the projection of a cleaning wire beyond a front end of a writing tube in a tubular writing instrument having a drop weight in accordance with claim 5, characterized in that the drop weight and cleaning wire assembly is inserted into the tubular writing instrument and brought into its frontal position, and then the upper and lower parts of the drop weight body are axially displaced in relation to each other until a desired projection of the cleaning wire has been attained.

19. A method for setting the projection of a cleaning wire beyond a front end of a writing tube in a tubular writing isntrument having a drop weight in accordance with claim 4, characterized in that the drop weight and cleaning wire assembly is inserted into the tubular writing instrument and brought into its frontal position, and then the upper and lower parts of the drop weight body are axially displaced in relation to each other until a desired projection of the cleaning wire has been attained.

20. A tubular writing instrument, comprising a drop weight and a cleaning wire fixed thereon, the drop weight including a drop weight body consisting of an upper part and a lower part, characterized in that the upper and lower parts are connected by threading, the lower part providing at a front surface thereof a support for the drop weight body in a frontal position inside the tubular writing instrument, wherein the upper and lower parts are displaceable in relation to each other in a direction of longitudinal extent of the cleaning wire in a first operational state and wherein further, a rear end of the cleaning wire is fastened to a front end of the upper part of the drop weight body and the upper and lower parts of the drop weight body are capable of being maintained in fixed positional alignment, for a second operational state.

21. A tubular writing instrument in accordance with claim 20, characterized in that the upper and lower parts are fixedly connected in the second operatoinal state.

22. A method for setting the projection of a cleaning wire beyond a front end of a writing tube in a tubular writing instrument having a drop weight in accordance with claim 20, characterized in that the drop weight and cleaning wire assembly is inserted into the tubular writing instrument and brought into its frontal position, and then the upper and lower parts of the drop weight body are axially displaced in relation to each other until a desired projection of the cleaning wire has been attained.

* * * * *